United States Patent [19]

Borisch et al.

[11] Patent Number: 4,986,315

[45] Date of Patent: Jan. 22, 1991

[54] WEAVING MACHINE WITH A SYNCHRONOUSLY OR INDEPENDENTLY OPERABLE MECHANICAL DOBBY

[76] Inventors: Fred Borisch, Breul 22, D-4400 Münster; Georg Kreisel, Unmatenstiege 10, D-4408 Dülmen, both of Fed. Rep. of Germany

[21] Appl. No.: 353,660

[22] PCT Filed: Jul. 15, 1988

[86] PCT No.: PCT/DE88/00437

§ 371 Date: Apr. 11, 1989

§ 102(e) Date: Apr. 11, 1989

[87] PCT Pub. No.: WO89/01540

PCT Pub. Date: Feb. 23, 1989

[30] Foreign Application Priority Data

Aug. 12, 1987 [DE] Fed. Rep. of Germany ... 8710997[U]
Jun. 3, 1988 [DE] Fed. Rep. of Germany ..... 3819004

[51] Int. Cl.[5] ..... D05C 1/12

[52] U.S. Cl. ..... 139/66 R; 139/1 E; 139/1 R; 139/336

[58] Field of Search ..... 139/1 R, 1 E, 66 R, 139/336 R, 66 A

[56] References Cited

U.S. PATENT DOCUMENTS

| | | | |
|---|---|---|---|
| 4,463,781 | 8/1984 | Binninger et al. | 139/1 E |
| 4,474,219 | 10/1984 | Froment | 139/66 R X |
| 4,478,254 | 10/1984 | Beaudoux et al. | 139/66 R X |
| 4,537,226 | 8/1985 | Gotoh | 139/1 E |
| 4,538,650 | 9/1985 | Kodama et al. | 139/452 |
| 4,592,392 | 6/1986 | Vandeweghe et al. | 139/1 E |
| 4,724,872 | 2/1988 | Speich | 139/1 E |

FOREIGN PATENT DOCUMENTS

| | | |
|---|---|---|
| 0107836 | 5/1984 | European Pat. Off. . |
| 3436165 | 5/1985 | Fed. Rep. of Germany . |
| 2273984 | 1/1976 | France . |

*Primary Examiner*—Andrew M. Falik
*Attorney, Agent, or Firm*—Peter K. Kontler

[57] ABSTRACT

A weaving installation includes a weaving machine and a dobby which can be driven by the weaving machine. In order for the weaving machine to drive the dobby, the weaving machine may be provided with a pulse generator for the transmission of pulses to a control unit which, in turn, regulates a motor coupled to the dobby. Alternatively, the camshaft of the weaving machine may be provided with an extension which is directly connected to the dobby. The dobby may also be driven independently of the weaving machine. In the case where the weaving machine has a pulse generator which controls a motor coupled to the dobby, this is accomplished in that the motor is operable even in the absence of pulses from the pulse generator. In the case where the camshaft of the weaving machine has an extension which is directly connected to the dobby, the dobby can be driven independently by a planetary gear on the extension. The planetary gear has a housing which is coupled, and is rotatable relative to, a motor and is also connected to the dobby thereby allowing the latter to be driven by the motor independently of the weaving machine. A brake enables the housing to be fixed against movement relative to the associated motor so that the dobby can be driven by the weaving machine.

8 Claims, 2 Drawing Sheets

PRIOR ART

WEAVING MACHINE WITH A SYNCHRONOUSLY OR INDEPENDENTLY OPERABLE MECHANICAL DOBBY

Figure 1:
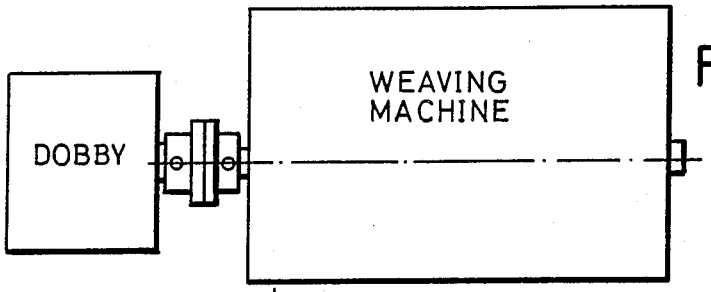

The invention relates to a weaving machine.

So-called mechanical dobbys are used in association with weaving machines and are rigidly coupled to the weaving machine in that the camshaft of the weaving machine drives the dobby. In such installations, the relationship of the change point to the beat up point of the batten is adjustable and such installations have been known for a long time.

For many applications, it would be of advantage if, on the one hand, the dobby could be driven by the weaving machine while, on the other hand, driving of the dobby independently of the camshaft of the weaving machine were also possible so that a "weft search", an influencing of the "changeover point" i.e., the point at which a harness change occurs, and a "shedding motion time reduction" could be achieved for weaving machines.

This object of the invention is achieved in that the drive connection between the camshaft of the weaving machine and the dobby can be modified by a separate drive.

In one embodiment of the invention, instead of a direct coupling to the weaving machine, the rate of change of the harness, which is set by eccentrics, is increased or decreased relative to the motion of the weaving machine by a separate drive. In this manner, it becomes possible to improve the fabric in a mechanical dobby by adjustment of the rate of change of the harness.

An electrically regulated motor, e.g., a step motor or AC-/DC-motor with suitable electronic controls or programming, can be used as a drive.

The triggering contact pulse preferably comes from the camshaft of the weaving machine or a programmed device and can be steplessly adjusted in time.

If programmable control of the drive is provided, then both the acceleration and deceleration periods of the motion, as well as the periods of movement and standstill, can be preprogrammed (e.g., for step motors and electronically controlled motors, the so-called acceleration and deceleration slopes).

When the weaving machine is stationary, the dobby can be moved forwards and backwards without movement of the batten. This can be of importance for various reasons, e.g., for the removal of threads in order to eliminate defects. After deactivation of the automatic starting mechanism by the contact pulse transmitter, the dobby can be rotated in the desired direction or to the desired position before the previously described normal operation with the automatic mechanism continues.

In another embodiment of the invention, the dobby is driven by the camshaft of the weaving machine during normal operation but such that, for specific applications, e.g., forward and backward rotation of the dobby, the drive connection between the weaving machine and the dobby can be modified. In accordance with this embodiment, a planetary gear is used as a coupling gear and this planetary gear is provided with a freely rotatable housing which is engaged by a servomotor. During normal operation of weaving machines and dobbys, this housing is fixed via a disc brake or other arresting element (a self-braking worm drive, a hydraulic cylinder, a pivot drive or a toggle joint with an arresting mechanism) so that the camshaft directly drives the dobby. On the other hand, during a so-called weft search, the housing is released and then driven by the servomotor so that driving of the dobby occurs via the servomotor and is not influenced by the camshaft of the weaving machine.

An important feature of the installation according to the invention resides in that the changeover point is programmable. Driving of the planetary gear housing occurs with each rotation of the main shaft (with each weft) and the adjustment preferably takes place in the resting phase of the eccentric so that the changeover period is not affected.

Figure 1A:
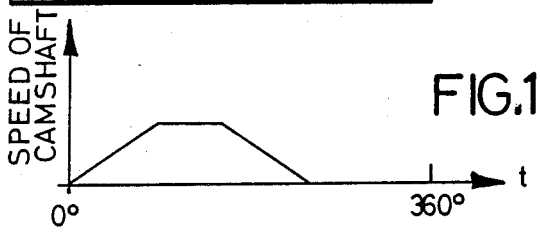
Figure 2:
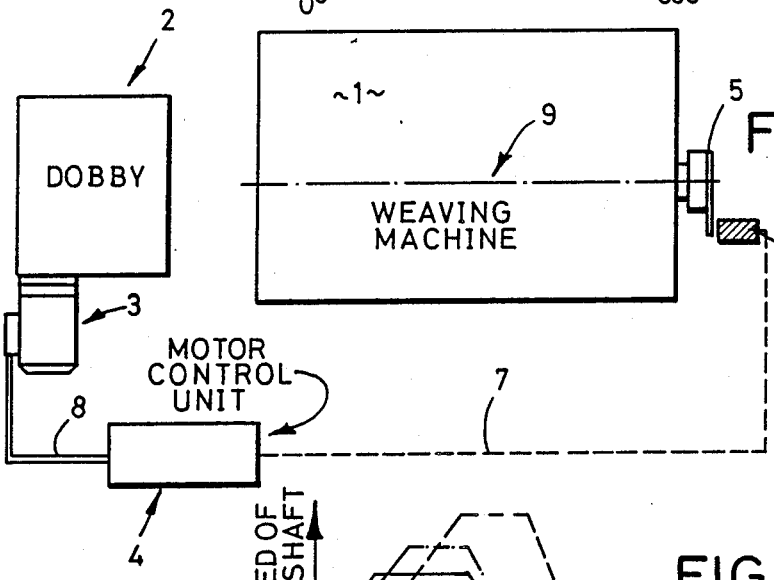
Figure 2A:
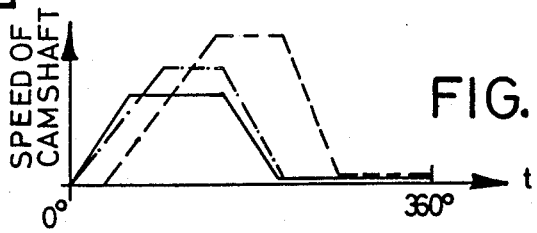
Figure 3:
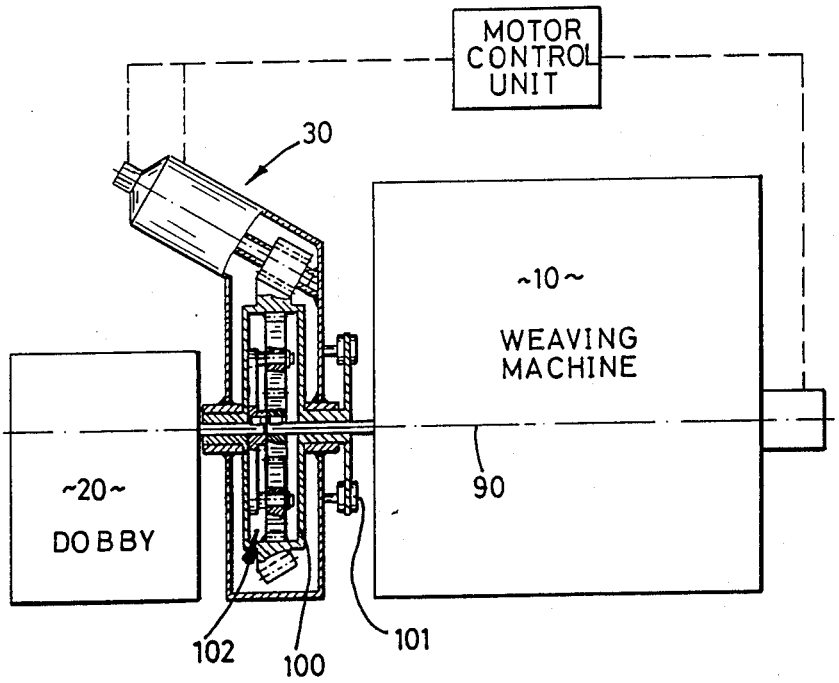

Exemplary embodiments of the invention are described below with reference to the drawings. In the drawings:

FIG. 1 is a schematic front view of a prior art weaving arrangement,

FIG. 1*a* shows the rate of change in the speed of the camshaft which drives the harnesses in the weaving arrangement of FIG. 1, FIG. 2 is a schematic front view of one embodiment of a weaving arrangement according to the invention, FIG. 2*a* shows the rate of change in the speed of the camshaft which drives the harnesses in the weaving arrangement of FIG. 2, and FIG. 3 is a partly sectional, schematic front view of another embodiment of the weaving arrangement in accordance with the invention.

In the prior art weaving arrangement of FIG. 1, the mechanical dobby is connected to the main shaft of the weaving machine via a rigid coupling so that it is not possible to alter the rate of change in the speed of the camshaft, and hence the rate of change of the harnesses.

In the novel installation (FIG. 2), 1 identifies a weaving machine and 2 a mechanical dobby which is driven by a motor 3, e.g., a geared motor, whose speed is adjustable. A linkage connects the motor 3 to a motor controller 4 and this, in turn, is connected by a conductor 7 to a contact pulse transmitter 6 which is influenced by a pulse generator 5 of the weaving machine 1.

As can be seen from the two graphs reproduced in FIGS. 1*a* and FIG. 2*a*, the rate of change in the speed of the camshaft of the new installation can be varied in that the dobby has its own motor instead of being directly coupled to the weaving machine. In this manner, the previously described advantages are achieved.

In FIG. 3, a camshaft 90 of a weaving machine 10 is shown. The mechanical dobby is indicated at 20. A planetary gear 102 is incorporated between the weaving machine 10 and the dobby 20 in the camshaft 90 and is equipped with a rotating housing 100 which can be arrested and fixed by a disc brake 101, for example. Other braking elements can be provided instead of the disc brake 101.

In the illustrated embodiment, the housing 100 is engaged by a servomotor 30 which is inoperative when the housing 100 is stationary but drives the housing, and thereby the planetary gear 102 as well as the dobby 20, when the housing 100 is released.

A manual crank, a manual lever arrangement, a hydraulic cylinder or a pivot drive may be used instead of the servomotor 30. A manual crank makes it possible, for example, to manually adjust the changeover point.

An hydraulic cylinder can serve, by way of example, for programmed automatic adjustment of the changeover point, and also to increase acceleration so as to reduce the period of rotation of the shaft.

A so-called weft search occurs with the weaving machine stationary, the brake 101 released and motive power being supplied by the servomotor 30.

Adjustment of the changeover point occurs with the weaving machine running, the brake released and additional motive power being supplied by the servomotor 30. The same applies for shedding motion time reduction.

We claim:

1. A weaving installation, comprising a weaving machine; a dobby; and means for driving said dobby, said driving means including first means responsive to operation of said weaving machine and second means operable independently of said weaving machine, said first means comprising a pulse generator, and said second means including a motor for said dobby operable in response to pulses produced by said pulse generator.

2. The installation of claim 1, wherein said first means further includes a control unit for said motor, said control unit being arranged to receive pulses produced by said pulse generator.

3. The installation of claim 1, wherein said first means further includes a pulse transmitter between said pulse generator and said motor.

4. The installation of claim 1, wherein said motor is an electronically regulated motor.

5. The installation of claim 1, wherein said motor is a geared motor.

6. A weaving installation, comprising a weaving machine; a dobby; means for driving said dobby, said driving means including first means responsive to operation of said weaving machine, second means operable independently of said weaving machine, and a planetary gear between said weaving machine and said dobby, said second means comprising a motor arranged to drive said planetary gear, and said planetary gear including a housing arranged to drive said dobby and to be driven by said motor, said housing being movable relative to said motor; and means for arresting said housing against movement relative to said motor.

7. The installation of claim 6, wherein said weaving machine has a shaft and said shaft has an extension to said dobby, said first means including said extension.

8. The installation of claim 6, wherein said weaving machine has a shaft and said shaft has an extension to said dobby, said first means including said extension and said planetary gear being mounted on said extension.

* * * * *